US010611556B2

(12) United States Patent
You

(10) Patent No.: US 10,611,556 B2
(45) Date of Patent: Apr. 7, 2020

(54) FOLDABLE CONTAINER, AND ELASTIC ROTATING APPARATUS FOR FOLDABLE CONTAINER

(71) Applicant: Hye Jin Yoo, Daejeon (KR)

(72) Inventor: Jae Sang You, Chungcheongbuk-do (KR)

(73) Assignee: Hye Jin Yoo, Daejeon (KR)

( * ) Notice: Subject to any disclaimer, the term of this patent is extended or adjusted under 35 U.S.C. 154(b) by 99 days.

(21) Appl. No.: 15/578,378

(22) PCT Filed: Apr. 5, 2016

(86) PCT No.: PCT/KR2016/003532
§ 371 (c)(1),
(2) Date: Nov. 30, 2017

(87) PCT Pub. No.: WO2016/195228
PCT Pub. Date: Dec. 8, 2016

(65) Prior Publication Data

US 2018/0148254 A1 May 31, 2018

(30) Foreign Application Priority Data

Jun. 2, 2015 (KR) ..... 10-2015-0077775

(51) Int. Cl.
*B65D 88/52* (2006.01)
*B65D 88/14* (2006.01)
(Continued)

(52) U.S. Cl.
CPC ..... *B65D 88/52* (2013.01); *B65D 88/12* (2013.01); *B65D 88/14* (2013.01); *B65D 88/524* (2013.01); *B65F 1/14* (2013.01)

(58) Field of Classification Search
CPC .... B65D 88/14; B65D 88/524; B65D 88/522; B65D 11/1826; B65D 90/021; B65D 88/52; B65D 11/18
(Continued)

(56) References Cited

U.S. PATENT DOCUMENTS 5,890,612 A * 4/1999 Coppi ..... B65D 88/524 206/600
5,941,405 A * 8/1999 Scales ..... B65D 88/522 220/1.5

FOREIGN PATENT DOCUMENTS

JP 2001-031184 A 2/2001
KR 20-0399802 Y1 11/2005
(Continued)

OTHER PUBLICATIONS

Search Report, dated Jul. 4, 2016, for International Application No. PCT/KR2016/003532.
(Continued)

*Primary Examiner* — Shawn M Braden
(74) *Attorney, Agent, or Firm* — LRK Patent Law Firm

(57) ABSTRACT

A foldable container includes a pair of lateral plates foldably formed between a top plate and a bottom plate, where the lateral plates include an upper lateral plate and a lower lateral plate which are inwardly foldable by a hinge. The upper and lower lateral plates of the lateral plates respectively include upper molds and lower molds at corners on both sides thereof, and the upper and lower molds are mutually locked or unlocked by means of movement of a locking means. Accordingly, it is possible to allow a user to simply lock or unlock the folding of the container by controlling the locking means in the process of folding the container, and enabling the upper and lower molds to be automatically unfolded.

9 Claims, 13 Drawing Sheets

(51) Int. Cl.
*B65D 88/12* (2006.01)
*B65F 1/14* (2006.01)

(58) Field of Classification Search
USPC ..... 220/6, 7, 666; 217/15; 312/258; 229/117
See application file for complete search history.

(56) References Cited

FOREIGN PATENT DOCUMENTS

| | | | |
|---|---|---|---|
| KR | 10-2006-0046708 | A | 5/2006 |
| KR | 10-1387393 | B1 | 4/2014 |
| WO | 2004-041680 | A1 | 5/2004 |
| WO | 2009-034142 | A1 | 3/2009 |

OTHER PUBLICATIONS

Written Opinion, dated Jul. 4, 2016, for International Application No. PCT/KR2016/003532.

* cited by examiner (a)

(b)

(a)

(b)

(a)

(b)

(a)

(b)

FOLDABLE CONTAINER, AND ELASTIC ROTATING APPARATUS FOR FOLDABLE CONTAINER

CROSS-REFERENCE TO RELATED APPLICATIONS

The present application is a U.S. National Phase entry from International Application No. PCT/KR2016/003532, filed Apr. 5, 2016, which claims priority to Korean Patent Application No. 10-2015-0077775, filed Jun. 2, 2015, the disclosure of which is incorporated by reference herein in its entirety.

BACKGROUND

1. Technical Field

The present invention relates to a foldable container and an elastic pivoting device for the foldable container, and more particularly, to a foldable container, which includes a pair of side plates between an upper plate and a lower plate, in which the upper plate is formed to allow an upper side plate and a lower side plate to be folded inward using a hinge portion, the upper and lower side plates include upper and lower molds provided at corners of both sides thereof, and a locking means moves such that the upper and lower molds are mutually locked or unlocked, and an elastic pivoting device for the foldable container, which is provided to hinge-pivot due to an elastic force such that an horizontally folded upper mold or lower mold is vertically unfolded.

2. Description of Related Art

Recently, as trade between nations is extensively conducted, effects of export and import on national economies are greatly increased. Particularly, in addition to development of aeronautical technology, trade using airplanes, which is different from conventional trade using ships, has been gradually increased.

Trade using airplanes has a technical advantage of quickly transporting cargo. Due to this, 25% of the entire export amount depends on airplanes.

Meanwhile, to transport cargo by airplane, a container for air cargo is used. The container for air cargo may have a form and a shape which differ according to an internal structure of an airplane or type of cargo being handled.

The container for air cargo prevents cargo from encountering dangerous situation such as being separated by vibrations or shocks caused by air currents generated during a flight, and a vacant container is collected again after use or stored in an airport to be used later.

A conventional container for air cargo had a limitation in being collected again due to problems caused by its volume and was uneconomic because it was difficult to efficiently utilize space due to a volume thereof while being stored in an airport.

Also, containers for air cargo do not continuously circulate depending on characteristics of exporting and importing nations. An oversupply phenomenon occurred in nations which import more and a shortage phenomenon occurred in nations which export more such that there was a vicious circle of wasting resources to continuously produce containers.

To solve this, there is an invention for disassembling and storing containers after use or reducing volumes of containers through folding.

However, disassembling and storing containers consumed a lot of manpower and time, in which there was a phenomenon in which a loss or a forgetful loss of components forming a container occurs which degrades durability during a process thereof.

Also, although there was a foldable folding container, there was a disadvantage of having to manually manipulate the container or having to unfold the container by using the force of a forklift.

As shown in FIG. 1, there is published Korean Patent Registration No. 10-1387393, titled "Auto folding air container" (registered on Apr. 15, 2014, hereinafter, referred to as "prior art document")

The prior art document had advantages of being configured to be foldable to reduce volume and be automatically foldable. However, an air inlet was provided at an air cylinder for folding side plates and it was necessary to supply air to the air inlet or to discharge air.

This caused difficulty in manufacturing, and providing the air cylinder and air inlet caused members of the container to become complicated. Also, since it was necessary to continuously supply and discharge air to and from the air inlet during a folding process, there was a problem of inconvenient operation.

In addition, since front and rear surfaces were opened in order to make the container foldable, it was necessary to additionally configure separate covering means. Even when an additional covering means was provided, there was a problem in which cargo became separated from the container by strong vibrations.

Meanwhile, the present invention is not limited to a container for air cargo and is applicable to prefabricated houses, containers for transporting vehicles, containers for ships, and the like, which are capable of being manufactured by using foldable containers.

SUMMARY

An aspect of the present invention provides a foldable container in which it is possible to reduce a volume thereof by simply, without a separate driving force means, folding side plates, mutually locking or unlocking upper and lower molds by using a locking means, allowing a pair of side plates to be automatically unfolded, allowing simple folding using manpower, allowing front and rear surfaces, even when folding the side plates to reduce the volume, to be covered, and forming an open portion at a side surface to allow easy loading of cargo.

According to one aspect of the present invention, there is provided a foldable container configured to allow a pair of side plates 300 to be foldable between an upper plate 100 and a lower plate 200, in which the side plate 300 is configured to allow an upper side plate 310 and a lower side plate 320 to be folded inward using a hinge portion 330, the upper and lower side plates 310 and 320 of the side plate 300 include upper and lower molds 311 and 321 at corners of both sides thereof, respectively, and a locking means 600 moves such that the upper and lower molds 311 and 321 are mutually locked or unlocked.

An elastic pivoting device 400 may be provided to hinge-pivot due to an elastic force between the upper plate 100 and the upper mold 311 of the upper side plate 310 or between the lower plate 200 and the lower mold 321 of the lower side plate 320 such that the horizontally folded upper mold 311 or lower mold 321 is vertically unfolded.

The elastic pivoting device 400 may include a pivoting rod 410 which slides in the upper mold 311 or the lower mold 321 and a pivoting guider 420 to surround the pivoting rod 410 and may include an elastic body 430 provided in the pivoting guider 420 to surround the pivoting rod 410 such that the elastic body 430 may pressurize the pivoting guider 420 and the elastic pivoting device 400 may hinge-pivot as a whole.

The pivoting rod 410 may include a support 411 formed thereon and the pivoting guider 420 may include a cylindrical pressurizer 421 which surrounds the pivoting rod 410 in a guider body 422 while both ends of the elastic body 430 are supported by the support 411 and the pressurizer 421 and pressurize the pressurizer 421 of the pivoting guider 420.

The elastic pivoting device 400 may include a hinge body 440 which includes a rod hinge 441 and a guider hinge 442 and may be coupled to the upper plate 100 or the lower plate 200 such that one end of the pivoting rod 410 pivots due to the rod hinge 441 and the guider body 422 of the pivoting guider 420 pivots due to the guider hinge 442.

A space portion 110 may be formed in the upper plate 100, and a front panel 120 and a rear panel 130 may be provided therein and slide outward from the upper plate 100 to cover a front surface and a rear surface of the foldable container FC.

Front and rear molds 121 and 131 may be provided at corners of both sides of the front panel 120 and the rear panel 130, respectively, and a locking means 140 may move such that the side plate 300 and the front and rear molds 121 and 131 of the front and rear panels 120 and 130 may be mutually locked or unlocked.

Coupling pieces 125 and 135 may be formed at bottom ends of the front panel 120 and the rear panel 130, respectively, and may be inserted into and fixed to coupling grooves 210 and 220 of the lower plate 200, respectively.

One side plate 300 of the pair of side plates 300 may be formed to partially correspond to the other side plate 300 and may include an open portion OP formed on a side surface thereof.

An independent frame 500 may be formed at the open portion OP to allow an upper frame 510 and a lower frame 520 to be folded inward using a frame hinge portion 530.

The locking means 600 may include guide rails 610 and 620 at the upper and lower molds 311 and 321, respectively, and may include a coupling rail 630 with one end coupled to any one of the guide rails 610 and 620 to pivot due to a rail hinge 640 and another end on which a sliding member 631 slides along the coupling rail 630 to be pressurized outward by an elastic member 633 such that the sliding member 631 may be inserted into and coupled to any one of the guide rails 610 and 620.

The sliding member 631 may include a rail holder 632 and the guide rails 610 and 620 may include holding grooves 650 such that the rail holder 632 is held by and fixed to the holding groove 650.

According to another aspect of the present invention, there is provided an elastic pivoting device 400 for unfolding panels with a mold at at least one corner of a foldable container FC so that the panels are mutually vertical. The elastic pivoting device 400 includes a pivoting rod 410 which slides in the mold of the panel and a pivoting guider 420 to surround the pivoting rod 410 and includes an elastic body 430 provided in the pivoting guider 420 to surround the pivoting rod 410 such that the elastic body 430 pressurizes the pivoting guider 420 and the elastic pivoting device 400 hinge-pivots as a whole.

The pivoting rod 410 may include a support 411 formed thereon and the pivoting guider 420 may include a cylindrical pressurizer 421 which surrounds the pivoting rod 410 in a guider body 422 while both ends of the elastic body 430 may be supported by the support 411 and the pressurizer 421 and may pressurize the pressurizer 421 of the pivoting guider 420.

The elastic pivoting device 400 may include a hinge body 440 which includes a rod hinge 441 and a guider hinge 442 and is coupled to the upper plate 100 or the lower plate 200 such that one end of the pivoting rod 410 may pivot due to the rod hinge 441 and the guider body 422 of the pivoting guider 420 may pivot due to the guider hinge 442.

A rod arm 450 may be coupled to one end of the pivoting rod 410 to pivot due to an arm hinge 451 such that one end of the rod arm 450 is coupled to pivot due to a rod hinge 441.

The rod arm 450 may have a shape curved in an opposite pivoting direction around a central shaft in a longitudinal direction.

Advantageous Effects

As described above, the present invention has a technical effect of allowing simple locking or unlocking a container through manipulation on a locking means by a user during a process of folding the container.

Also, there is a technical effect in which an elastic pivoting device is provided between an upper plate or a lower plate and an upper or lower mold of an upper or lower side plate to hinge-pivot due to an elastic force to allow the horizontally folded upper and lower molds to be automatically unfolded.

Hereby, even when the container does not include a separate driving force means, the container for air cargo may be simply folded by using the forklift.

In addition, since it is possible to pressurize in a direction opposite to the elastic force by only using manpower during a folding process, there is an advantage of being able to simply fold the container.

Also, since a space portion is formed in an upper plate, and a front panel and a rear panel are provided therein and slide outward from the upper plate, there is an effect of being able to cover a front surface and a rear surface of the container for air cargo.

Hereby, there is an additional advantage of being able to effectively load air cargo by extending an open portion by selectively opening and closing the front panel and the rear panel.

Also, there is a technical effect of being able to stably cover front and rear surfaces as necessary while reducing a volume of the container.

In addition, there are technical effects of being able to easily load cargo by forming an open portion at a side surface and to effectively fold the container in a safe manner by forming an independent frame.

DETAILED DESCRIPTION OF THE INVENTION

Hereinafter, the present invention will be described in detail with reference to the attached drawings.

Figure 1:
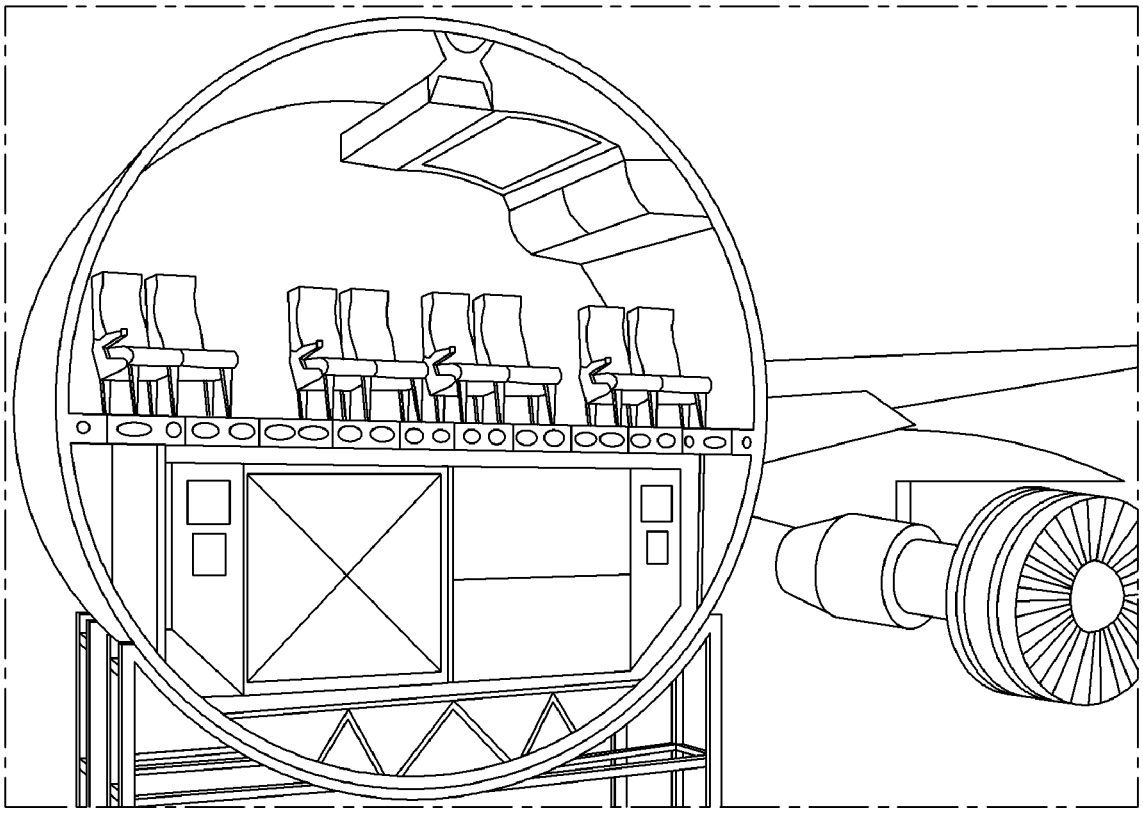
FIG. 1 is a view illustrating a state of using a container for air cargo.

FIG. 1 is a cross-sectional photo of an airplane on which a general container for air cargo is loaded. As shown in FIG. 1, it is very uneconomic to collect and store the general container for air cargo after use due to limitations caused by a volume thereof. Accordingly, there have been folding containers manufactured to be foldable. However, there was a problem in which front and rear surfaces were open. There was an additional problem in which cargo deviated due to vibration and the like even when additional covering means were provided.

Figure 2:
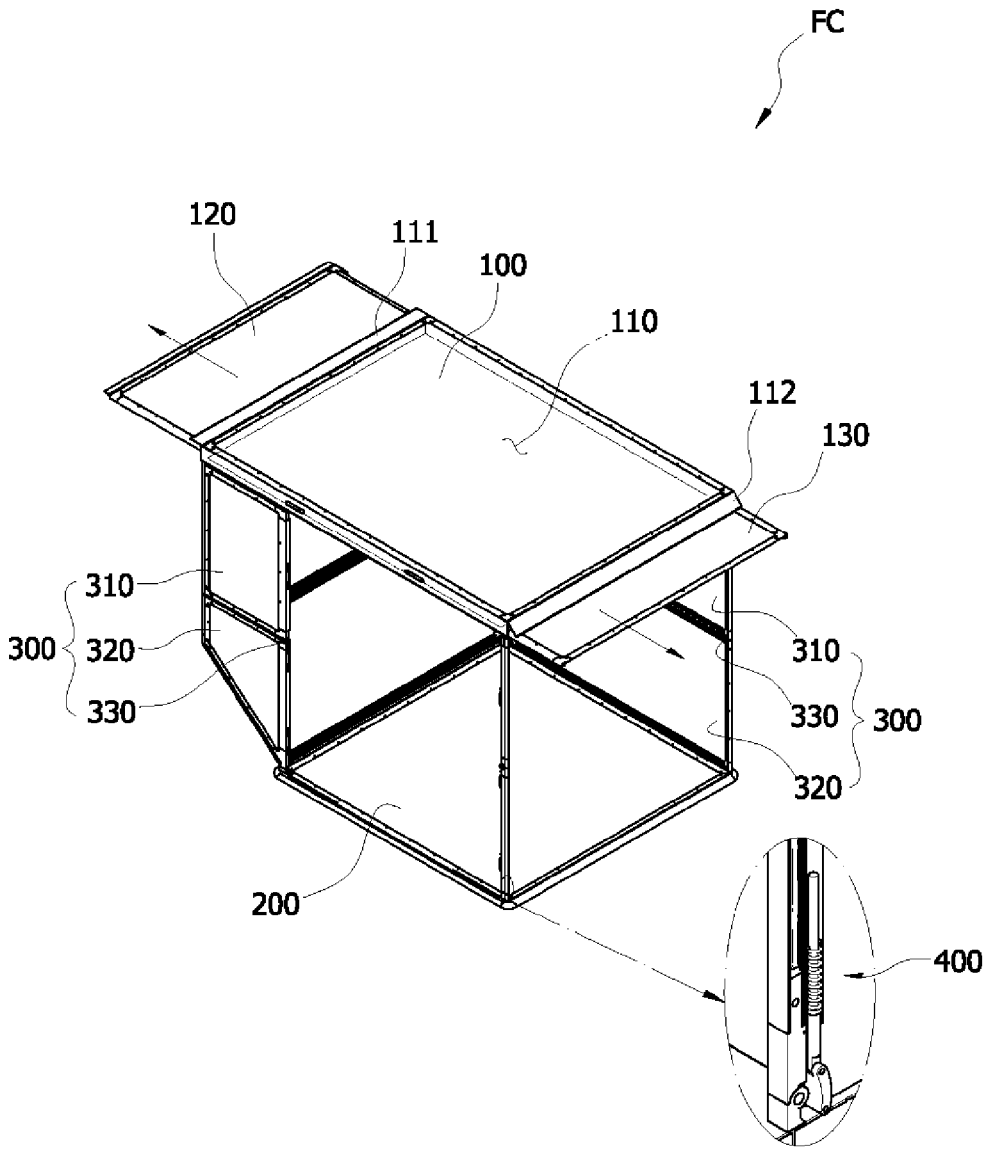
FIG. 2 is a perspective view of a foldable container according to one embodiment of the present invention.

As shown in FIG. 2, a foldable container FC according to one embodiment of the present invention is configured to allow a pair of side plates 300 to be foldable between an upper plate 100 and a lower plate 200.

The side plate 300 is configured to allow an upper side plate 310 and a lower side plate 320 to be foldable inward using a hinge portion 330.

A variety of methods of folding the pair of side plates 300 may be variously designed, but it is most advantageous in an aspect of space utilization that the upper and lower side plates 310 and 320 are formed to be folded inward.

Figure 3:
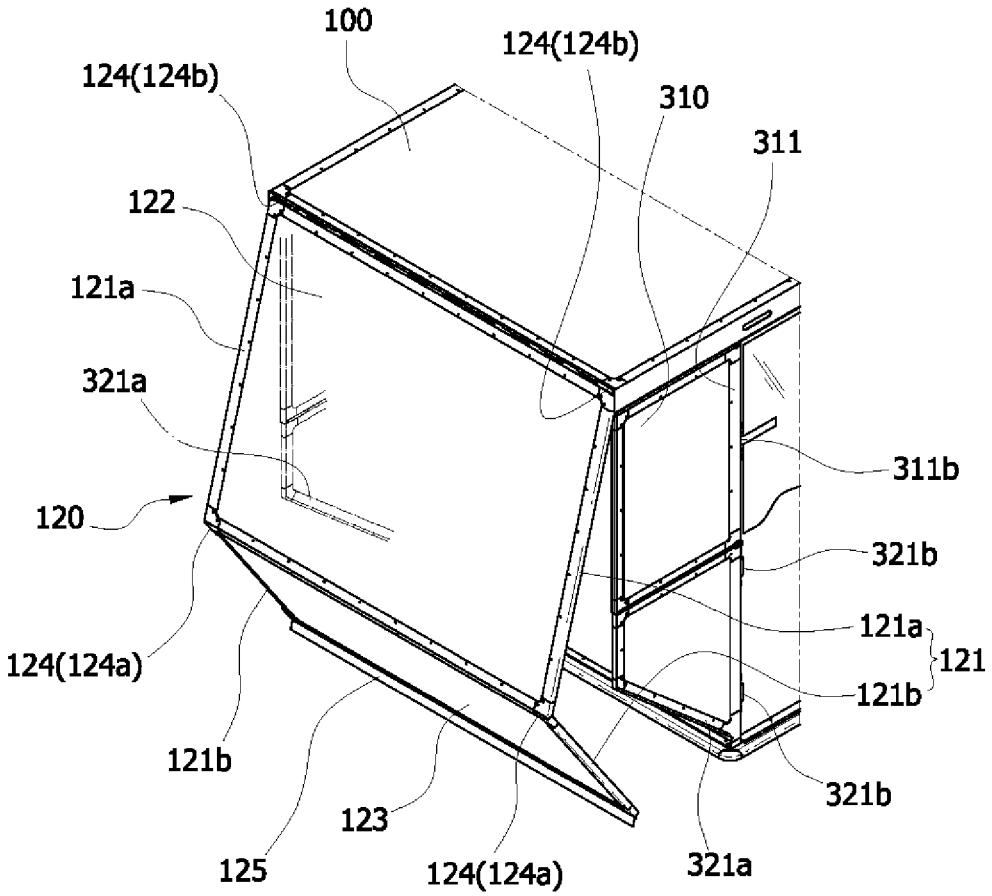
FIG. 3 is a detailed perspective view of the foldable container according to one embodiment of the present invention.

As shown in FIG. 3, the upper and lower side plates 310 and 320 of the side plates 300 include upper and lower molds 311 and 321 at both corners thereof.

When the upper and lower molds 311 and 321 are provided at both corners of the upper and lower side plates 310 and 320, the hinge portion 330 may be provided only between the molds such that simplicity in manufacturing and ease of folding may be provided.

Also, the molds are provided to surround the side plates such that structural safety and durability of the side plates 300 may be provided.

Here, locking means 600 moves to allow the upper and lower molds 311 and 321 to be mutually locked or unlocked. Hereby, there is a technical effect of being able to simply lock or unlock the container by only moving the locking means 600.

Meanwhile, an elastic pivoting device 400 may be provided to be hinge-pivotable due to an elastic force between the upper plate 100 and the upper mold 311 of the upper side plate 310 or between the lower plate 200 and the lower mold 321 of the lower side plate 320.

That is, due to the elastic force of the elastic pivoting device 400, the upper mold 311 pivots downward and the lower mold 321 pivots upward such that the horizontally folded upper mold 311 or lower mold 321 may be vertically unfolded.

Figure 11:
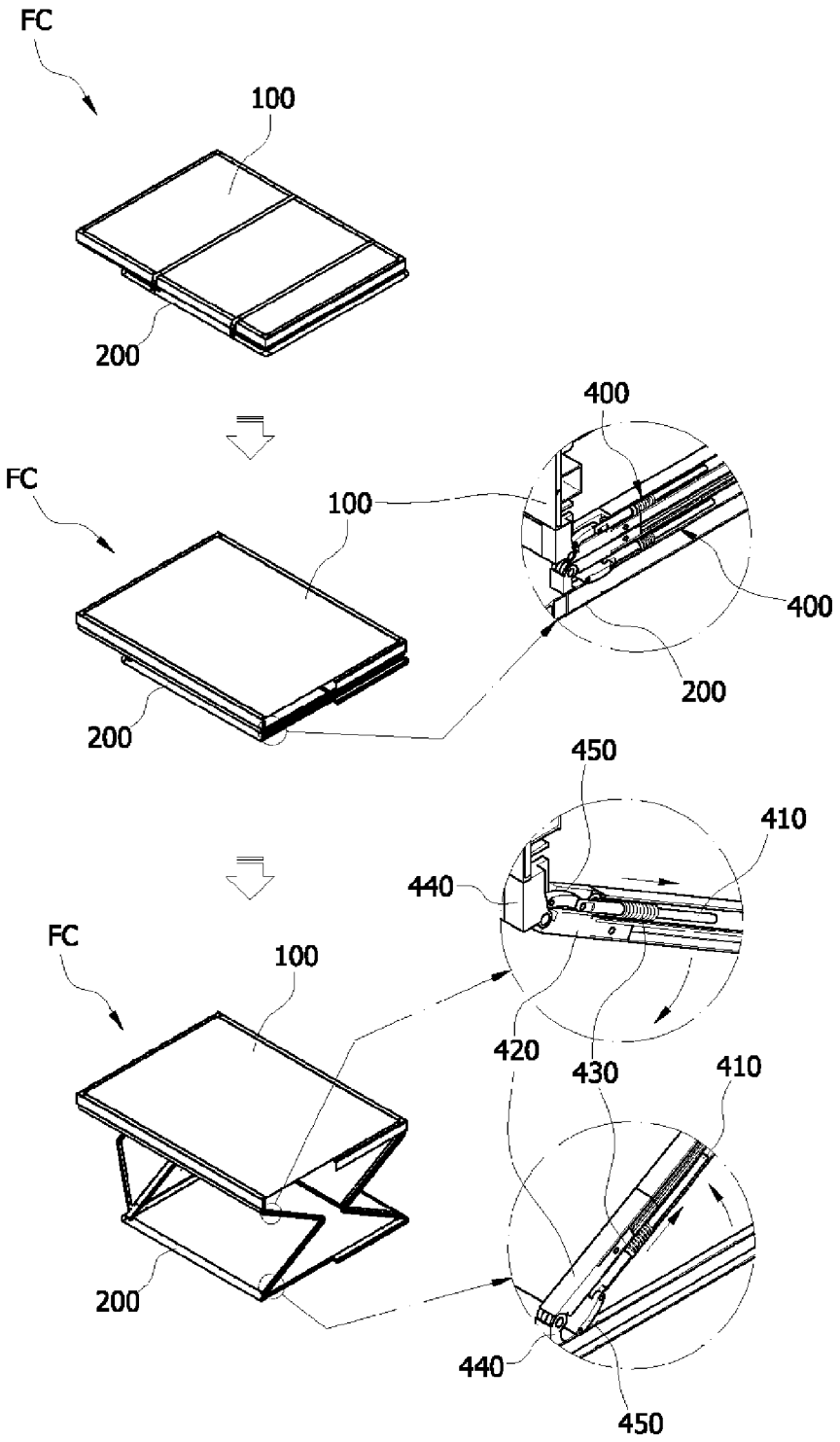
FIGS. 11 and 12 are perspective views illustrating unfolding the foldable container according to one embodiment of the present invention.
Figure 12:
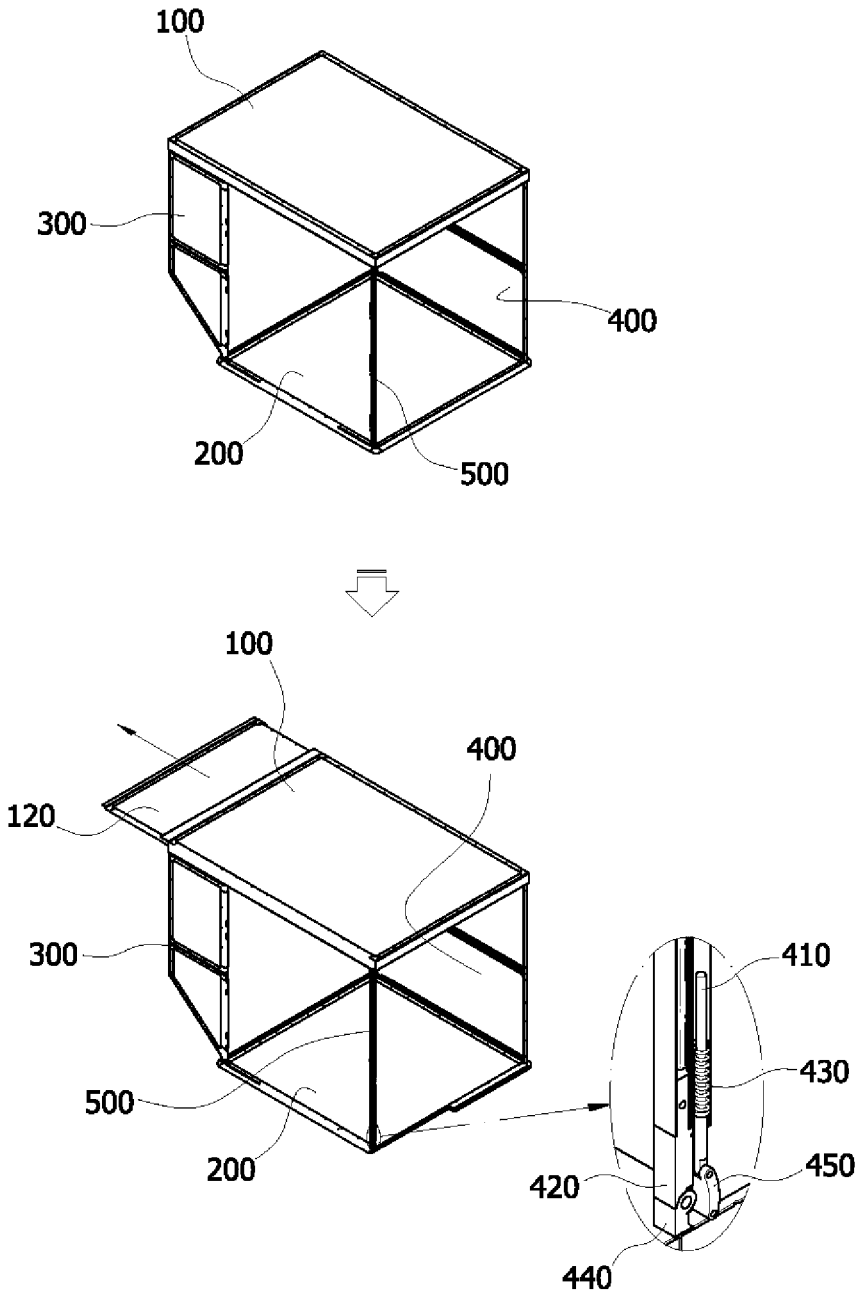

Hereby, as shown in FIGS. 11 and 12, the foldable container FC according to one embodiment of the present invention may have a technical effect of automatically unfolding the upper plate 100 or the lower plate 200 and the upper and lower side plates 310 and 320.

Also, the elastic pivoting device 400 may be provided at only the upper plate 100 or the lower plate 200. In this case, a hinge is provided between the upper and lower plates 100 and 200 and the upper and lower molds 311 and 321 at which the elastic pivoting device 400 is not provided such that the container may be naturally unfolded by a restoration force of the elastic pivoting device 400.

On the other hand, since it is possible to pressurize in a direction opposite to the elastic force by only using manpower during a folding process, the container may be simply folded.

Figure 4:
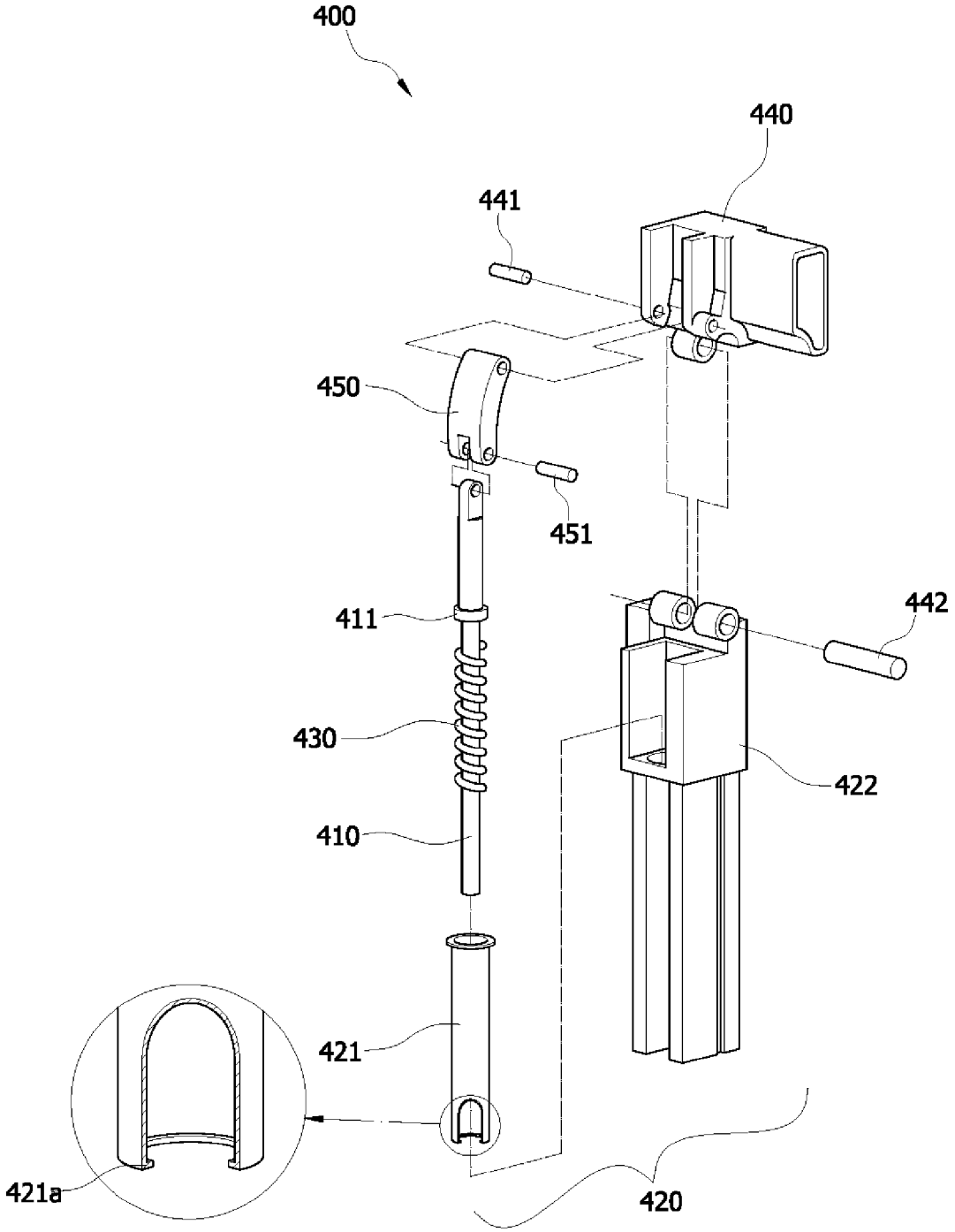
FIG. 4 is an exploded perspective view illustrating an elastic pivoting portion of the foldable container according to one embodiment of the present invention.

In detail, as shown in FIG. 4, the elastic pivoting device 400 may include a pivoting rod 410 which slides in the upper mold 311 or the lower mold 321 and a pivoting guider 420 to surround the pivoting rod 410.

Here, an elastic body 430 is provided in the pivoting guider 420 to surround the pivoting rod 410 and pressurizes the pivoting guider 420 such that the elastic pivoting device 400 may be hinge-pivotable as a whole.

Although a coil spring is shown as an example of the elastic body 430, it may be replaced by a variety of other means capable of applying a pressure such as a rubber material, a plate spring, and the like.

Figure 5:
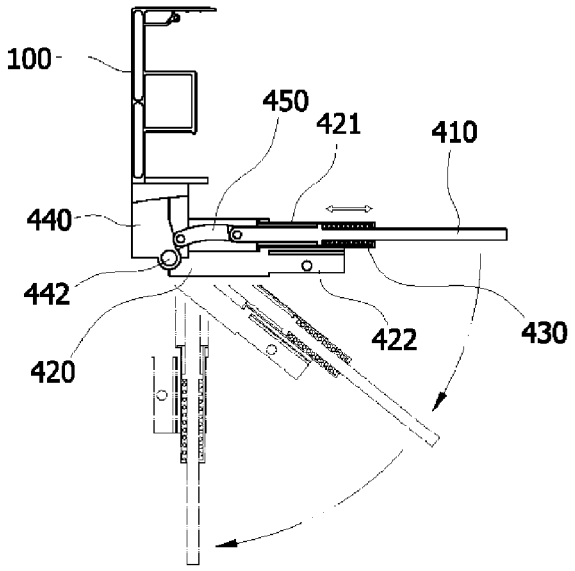
FIG. 5(*a*) and FIG. 5(*b*) are cross-sectional views illustrating an operating principle of the elastic pivoting portion of the foldable container according to one embodiment of the present invention.
Figure 5:
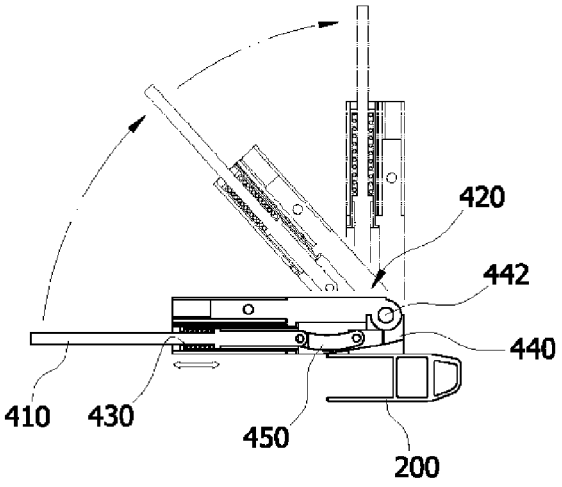

That is, as shown in (a) and (b) of FIG. 5, when the elastic body 430 provided between the pivoting rod 410 and the pivoting guider 420 pressurizes the pivoting guider 420 with an elastic force, the pivoting guider 420 hinge-pivots and the pivoting rod 410 provided in the pivoting guider 420 also pivots such that the pivoting rod 410, which slides in the upper and lower molds 311 and 321, allows the upper and lower molds 311 and 321 to pivot as a whole and allows the upper and lower side plates 310 and 320 to be unfolded with the hinge portion 330 as the center thereof.

Meanwhile, the pivoting rod 410 includes a support 411 formed thereon and the pivoting guider 420 includes a cylindrical pressurizer 421 which surrounds the pivoting rod 410 in a guider body 422 while both ends of the elastic body 430 may be supported by the support 411 and the pressurizer 421 and may pressurize the pressurizer 421 of the pivoting guider 420.

Accordingly, the elastic body 430 pressurizes the pressurizer 421 of the pivoting guider 420 through a restoration force, and the pivoting guider 420 which receives the applied pressure allows the elastic pivoting device 400 to pivot as a whole.

In more detail, the pressurizer 421 includes a lip portion 421*a* thereinside and the elastic body 430 is provided between the pivoting rod 410 and the pressurizer 421 such that one end of the elastic body 430 may be supported by the lip portion 421*a*.

Also, the elastic body 430 may be fixed to the pivoting rod 410 not only by the support 411 but also by a variety of methods such as a fixing hole and the like.

The upper and lower molds 311 and 321 of the upper and lower side plates 310 and 320 which form the side plates 300 may be inserted into and coupled to the guider body 422.

Meanwhile, in the elastic pivoting device 400, a hinge body 440 including a rod hinge 441 and a guider hinge 442 may be coupled to the upper plate 100 or the lower plate 200.

The rod hinge 441 and the guider hinge 442 may be directly provided at the upper plate 100 or the lower plate 200. However, for efficiency of manufacturing, the hinge body 440 including the rod hinge 441 and the guider hinge 442 may preferably be coupled to the upper plate 100 or the lower plate 200.

One end of the pivoting rod 410 may be provided to pivot due to the rod hinge 441, and the guider body 422 of the pivoting guider 420 may be provided to pivot due to the guider hinge 442.

Here, the rod hinge 441 and the guider hinge 442 may be arranged to be uneven and not coaxially formed.

In detail, the elastic body 430 applies a pressure along a central shaft of the provided pivoting rod 410 but a central shaft of the guider body 422 is formed in a direction opposite to a pivoting direction of the pivoting rod 410 such that a center of gravity may be formed in an opposite pivoting direction of the rod hinge 441 and accordingly more effective pivoting may be performed.

Meanwhile, a rod arm 450 is coupled to the one end of the pivoting rod 410 to pivot due to an arm hinge 451, and one end of the rod arm 450 may be coupled to pivot due to the rod hinge 441.

Since the arm hinge 451 and the rod hinge 441 are provided at both ends of the rod arm 450, a pivoting radius of the pivoting rod 410 is decreased such that efficient pivoting is possible. Since the pivoting rod 410 pivots due to two hinges, a technical effect of easily pivoting with elasticity is provided.

Here, the rod arm 450 may have a shape curved in a direction opposite to a pivoting around a central shaft in a longitudinal direction.

Hereby, since the center of gravity is naturally formed in an opposite pivoting direction, the pivoting guider 420 and the pivoting rod 410 may more easily pivot due to the restoration force of the elastic body 430 than the pivoting direction.

Even when the rod arm 450 is not present, a curved portion is formed at an end of the rod hinge 441 side of the pivoting rod 410 to provide the same effect. The curved shape does not matter and the same effect may be provided by designing the center of gravity to be formed in the opposite pivoting direction.

As shown in FIG. 2, a space portion 110 is formed in the upper plate 100, and a front panel 120 and a rear panel 130 are provided therein and slide outward from the upper plate 100 to cover a front surface and a rear surface of the foldable container FC.

Since it is difficult to embody both of the side plates and front and rear plates to be folded at the same time due to a limitation in space between the upper plate and the lower plate, the front panel 120 and the rear panel 130 slide outward to cover the front surface and the rear surface while the foldable container FC is unfolded such that there is a technical effect of easily performing a folding process and stably covering the front and rear surfaces as necessary while reducing a volume of the foldable container FC.

Here, a front cover 111 and a rear cover 112 are provided on front and rear sides of the upper plate 100 and may cover the front and rear of the space portion 110 at which the front panel 120 and the rear panel 130 are provided.

Figure 6:
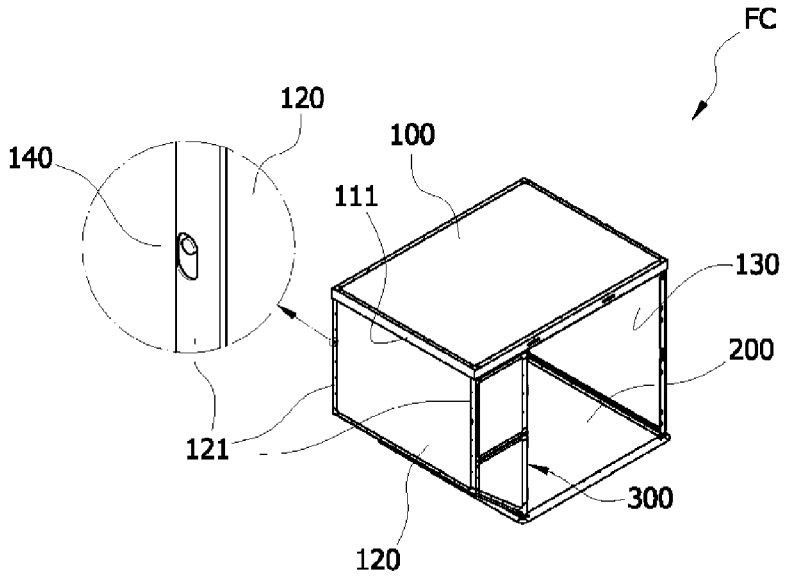
FIGS. 6(*a*), 6(*b*) and 7 are perspective views illustrating a locking means of the foldable container according to one embodiment of the present invention.
Figure 6:
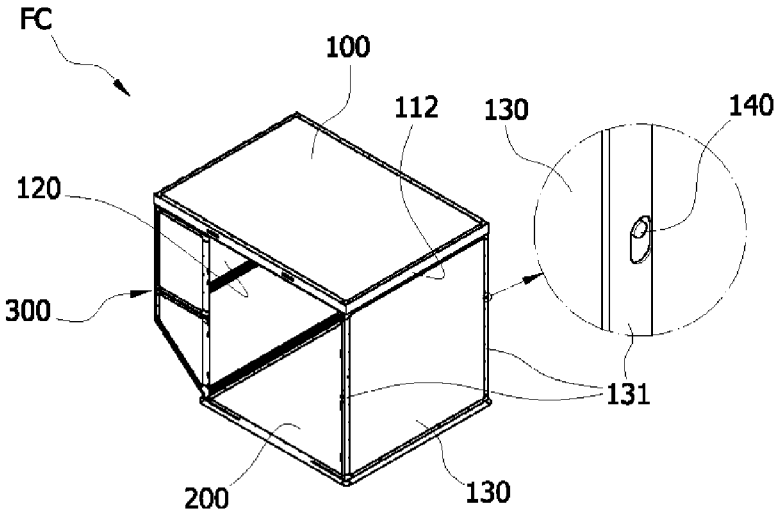

Meanwhile, as shown in (a) and (b) of FIG. 6, front and rear molds 121 and 131 are provided at both corners of the front panel 120 and the rear panel 130 while a locking means 140 is provided at the front and rear molds 121 and 131 such that the side plates 300 and the front panel 120 or the rear panel 130 may be mutually locked or unlocked by moving the locking means 140 upward and downward.

Figure 7:
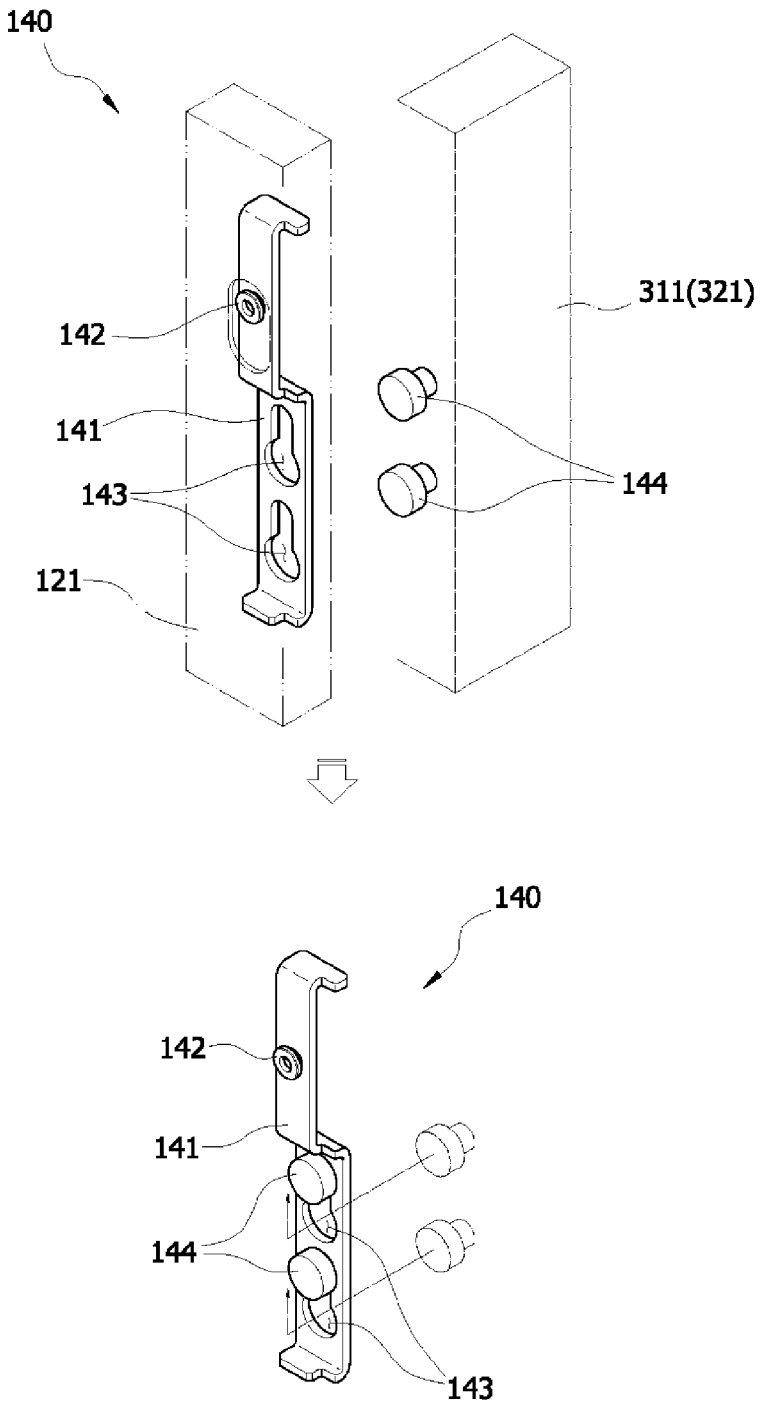

Although embodied in a variety of methods, the locking means 140 may be configured, as an example, as shown in FIG. 7, to include a locking piece 141 having a ㄹ shaped cross section, a grip portion 142 on one side of the locking piece 141 and a holding hole 143 which prevents a holding head 144 from being separated while being inserted, on the other side thereof such that the holding hole 143 of the locking piece 141 vertically moves by a vertical movement of the grip portion 142 so as to be held or released by the holding head 144.

Here, the holding head 144 may be provided at the pair of side plates 300 and preferably may be provided at the upper and lower molds 311 and 321.

Accordingly, there is a technical effect in which the side plate 300 and the front and rear molds 121 and 131 of the front and rear panels 120 and 130 may be simply locked by a user manipulating the locking means and may be simply unlocked to be folded when being disassembled.

Figure 8:
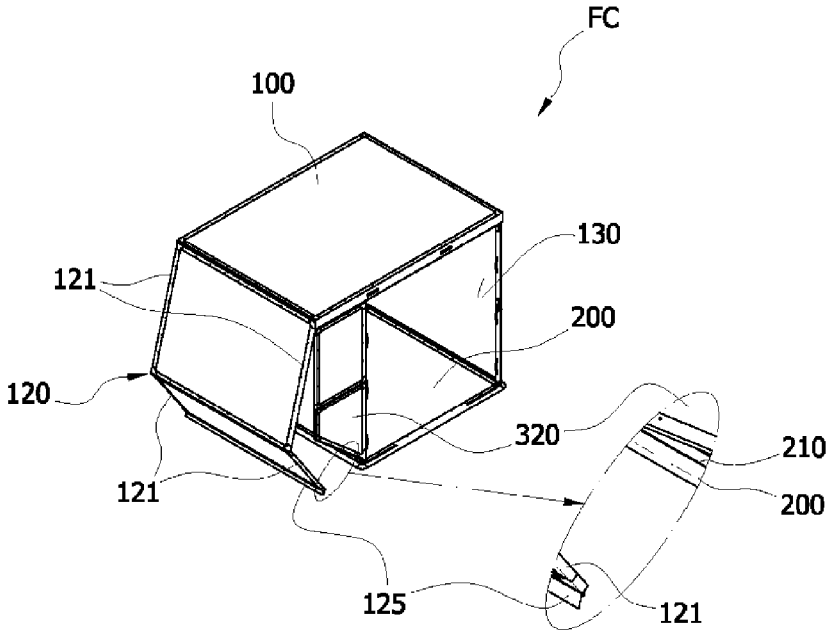
FIG. 8(*a*) and FIG. 8(*b*) are perspective views illustrating front and rear panels of the foldable container according to one embodiment of the present invention.
Figure 8:
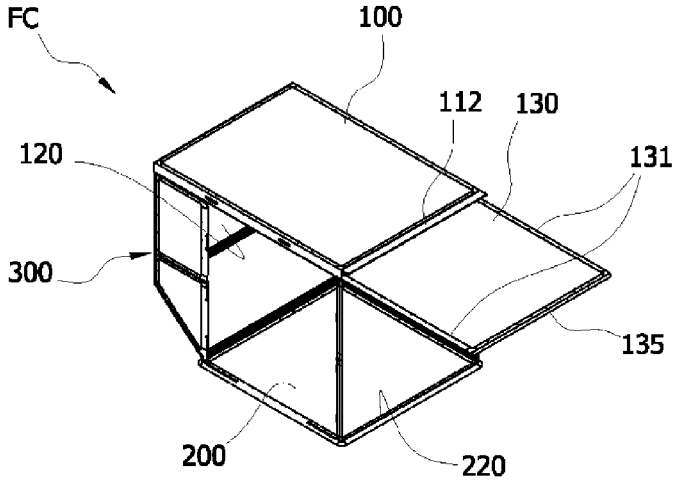

Also, as shown in (a) and (b) of FIG. 8, coupling pieces 125 and 135 may be formed at bottom ends of the front panel 120 and the rear panel 130, respectively, and may be inserted into and fixed to coupling grooves 210 and 220 of the lower plate 200, respectively.

In more detail, the coupling pieces 125 and 135 are formed along corners of the bottom ends of the front panel 120 and the rear panel 130 in a longitudinal direction while being bent outward to be inserted into and simultaneously held and coupled to the coupling grooves 210 and 220 such that separation is prevented. The coupling pieces 125 and 135 are inserted into the coupling grooves 210 and 220 and then the locking means 140 is manipulated such that assembling of the front panel 120 and the rear panel 130 is completed and disassembling thereof is performed in a reverse order.

Figure 9:
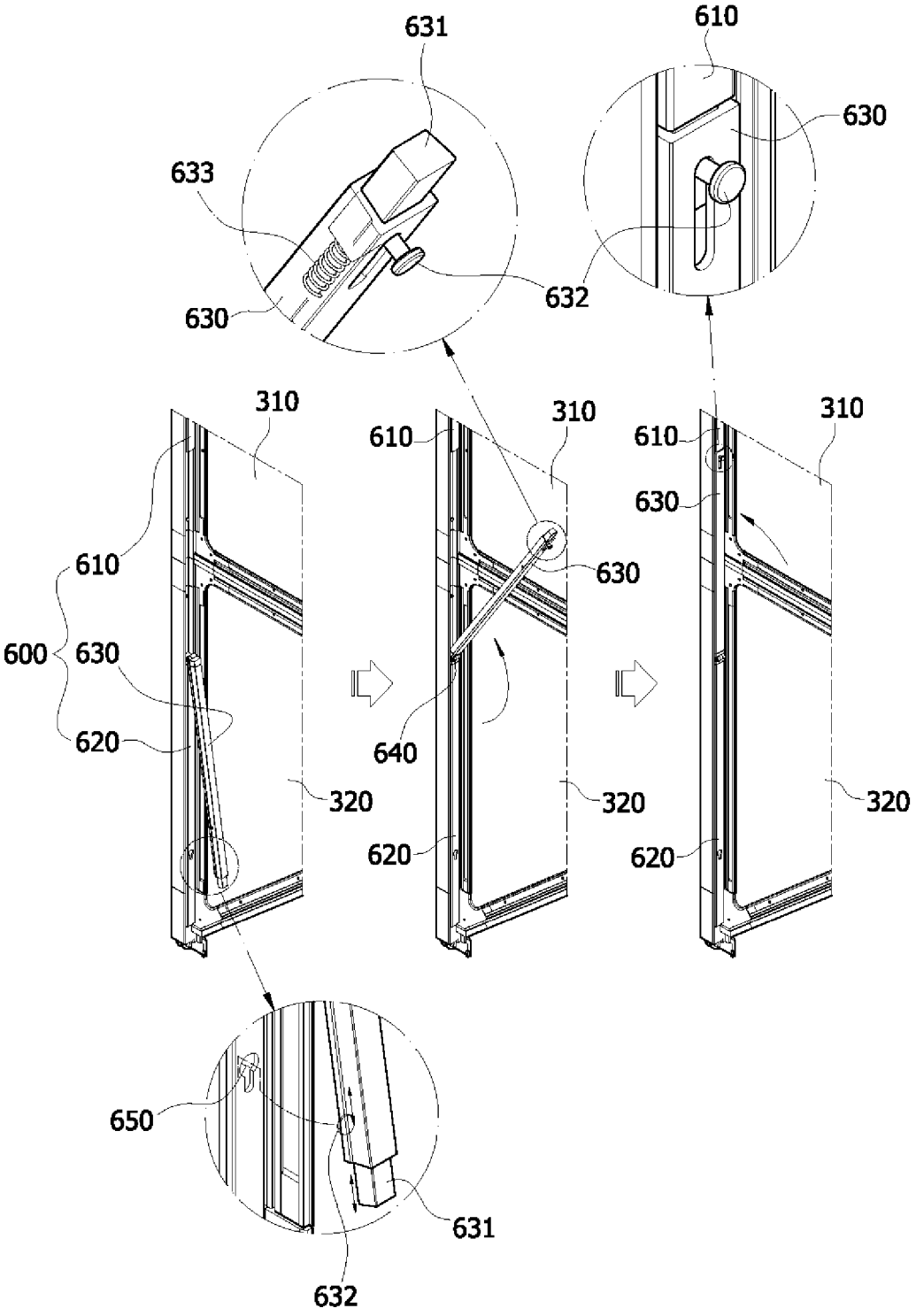
FIG. 9 is a perspective view illustrating the locking means of the foldable container according to one embodiment of the present invention.

Meanwhile, as shown in FIG. 9, the locking means 600 is provided such that the upper and lower molds 311 and 321 may be mutually locked or unlocked by moving the locking means 600 upward or downward.

Although the locking means 600 may be embodied in a variety of methods, as an example, the locking means 600 may include guide rails 610 and 620 at the upper and lower molds 311 and 321 while one end of a coupling rail 630 is coupled to any one of the guide rails 610 and 620 to pivot due to a rail hinge 640.

Here, a sliding member 631 slides at the other end of the coupling rail 630 along the coupling rail 630 while being pressurized outward by an elastic member 633 such that the sliding member 631 may be inserted into and coupled to any one of the guide rails 610 and 620.

The sliding member 631 may include a rail holder 632 such that coupling may be released by moving the sliding member 631 opposite to a pressurizing direction of the elastic member 633 while gripping the elastic member 633, and the rail holder 632, in order to be folded, may be held by and fixed to holding grooves 650 formed at the guide rail 610 and 620.

Meanwhile, in the lower side plate 320 of the pair of side plates 300, the lower mold 321 on one side may have an inclined portion 321*a* to face each other.

An objective of the inclined portion 321*a* is to efficiently utilize a space by using a standardized shape of the container for air cargo.

Meanwhile, the inclined portion 321*a* has an unfavorable structure for folding of the automatically foldable container FC for air cargo according to one embodiment of the present invention and particularly has a great limitation in forming the front panel 120.

Hereupon, as shown in FIG. 3, an upper front panel 122 and a lower front panel 123 of the front panel 120 are formed to be folded inward using a front hinge portion 124 such that the lower front panel 123 may cover the inclined portion 321*a*.

Hereby, a technical effect of effectively covering the inclined portion 321*a* while forming the front panel 120 is provided.

Meanwhile, upper and lower front molds 121*a* and 121*b* are provided at corners of both sides of the upper and lower front panels 122 and 123 and may be folded by a central front hinge 124*a*.

Here, since the upper and lower front panels 122 and 123 are configured to be surrounded by the molds, the front hinge portion 124 is provided only between the molds such that simplicity in manufacturing and ease folding may be provided.

The front hinge portion 124 may include the central front hinge 124*a* between the upper and lower front molds 121*a* and 121*b* and may include an upper front hinge 124*b* between the upper plate 100 and the upper front mold 121*a*.

Figure 10:
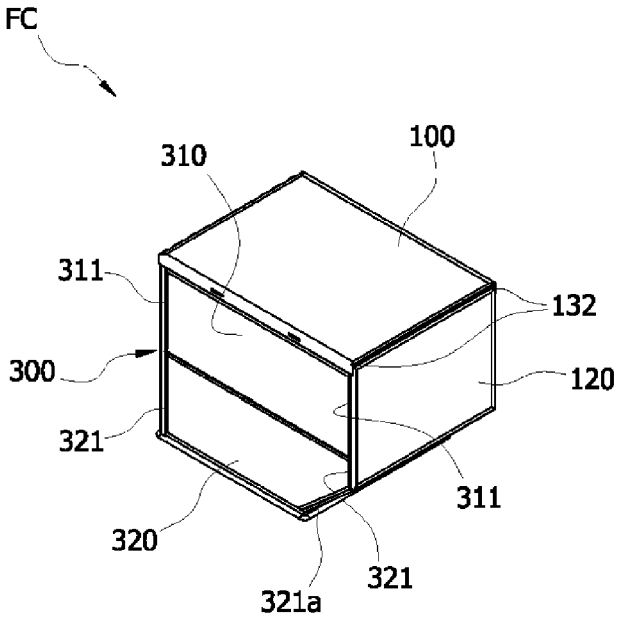
FIG. 10(*a*) and FIG. 10(*b*) are perspective views of the foldable container according to one embodiment of the present invention.
Figure 10:
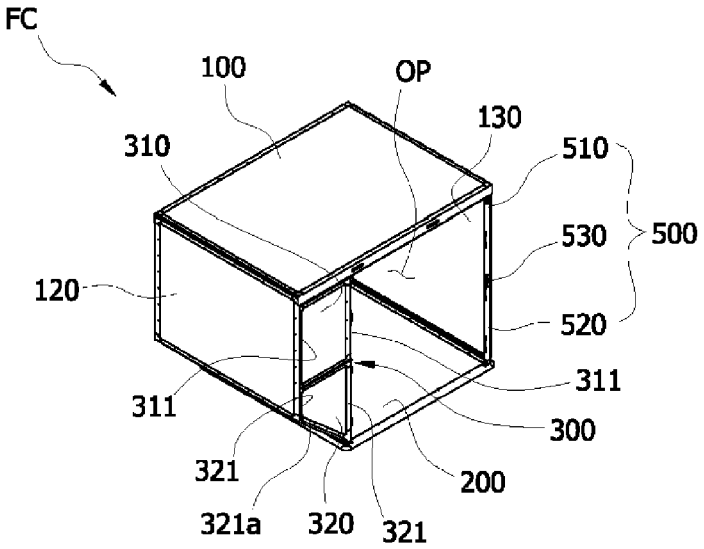

Also, as shown in FIG. 10(*a*), a rear hinge portion 132 of the rear panel 130 may be provided between the upper plate 100 and the rear mold 131.

Meanwhile, as shown in FIG. 10(*b*), one side plate 300 of the pair of side plates 300 is formed to partially correspond to the other side plate 300 such that an open portion OP may be formed on a side surface thereof.

The open portion OP functions to allow easy loading of air cargo and is open along with the front panel 120 and the rear panel 130 for loading of the air cargo and then may cover the front surface and the rear surface.

Also, the upper and lower molds 311 and 321 provided at a side portion of the open portion OP include net holders 311*b* and 321*b* to fasten a cover net which prevents cargo from being exposed.

Here, an independent frame 500 may be formed at the open portion OP to allow an upper frame 510 and a lower frame 520 to be folded inward using a frame hinge portion 530.

The independent frame 500 may be provided to face the upper and lower molds 311 and 321 on one side of the side plate 300 and may be folded by the frame hinge portion 530 such that the open portion OP has structural safety.

Here, the independent frame 500 may also include the locking means 600 such that the upper frame 510 and the lower frame 520 may be mutually locked or unlocked by vertically moving the locking means 600.

Also, the elastic pivoting device 400 is provided to hinge-pivot due to an elastic force between the upper plate 100 and the upper frame 510 or between the lower plate 200 and the lower frame 520 such that the horizontally folded upper frame 510 or lower frame 520 may be vertically unfolded.

Figure 13:
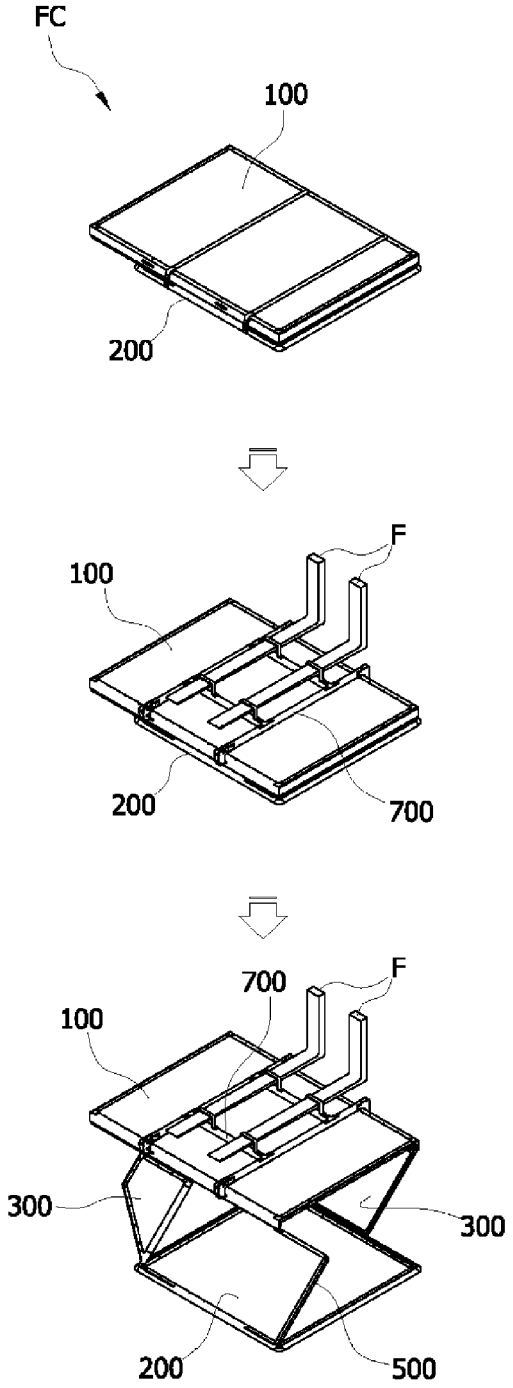
FIG. 13 is a view illustrating a foldable container in a state of being used according to another embodiment of the present invention.

Meanwhile, the foldable container FC according to one embodiment of the present invention may be embodied to be manually unfolded without the elastic pivoting device 400. Here, as shown in FIG. 13, clamp holes may be formed at both sides of the upper plate 100, and fork holders 700 are fixed to the clamp holes 150 and forks F of a forklift are inserted into and coupled to the fork holders 700 and move upward and downward such that the foldable container FC according to one embodiment of the present invention may be easily folded.

Hereby, even when the foldable container FC does not include a separate driving force means, the container may be simply folded by using the forklift.

Also, when the elastic pivoting device 400 is not provided, an upper hinge may be provided between the upper plate 100 and the upper side plate 310 and a lower hinge may be provided between the lower plate 200 and the lower side plate 320.

That is, the hinge portion 330 may be embodied to be folded inward using a central hinge provided between the upper side plate 310 and the lower side plate 320 and the upper and lower hinges.

It should be understood that the foldable container FC and the elastic pivoting device 400 for the foldable container according to one embodiment of the present invention, described above, are not limited to the above embodiments and a variety of modifications made by one of ordinary skill in the art without departing from the essential of the present invention are included in the scope of the claims of the present invention.

The invention claimed is:

1. A foldable container configured to allow a pair of side plates to be foldable between an upper plate and a lower plate, wherein:

the side plate is configured to allow an upper side plate and a lower side plate to be folded inward using a hinge portion, the upper and lower side plates of the side plate comprise upper and lower molds at corners of both sides thereof, respectively, and a locking means moves such that the upper and lower molds are mutually locked or unlocked, wherein an elastic pivoting device is provided to hinge-pivot, due to an elastic force, between the upper plate and the upper mold of the upper side plate or between the lower plate and the lower mold of the lower side plate such that the horizontally folded upper mold or lower mold is vertically unfolded, and wherein the elastic pivoting device comprises a pivoting rod which slides in the upper mold or the lower mold and a pivoting guider to surround the pivoting rod 410, and comprises an elastic body provided in the pivoting guider to surround the pivoting rod such that the elastic body pressurizes the pivoting guider and the elastic pivoting device hinge-pivots as a whole.

2. The foldable container of claim 1, wherein the pivoting rod comprises a support formed thereon and the pivoting guider comprises a cylindrical pressurizer which surrounds the pivoting rod in a guider body while both ends of the elastic body are supported by the support and the pressurizer and pressurize the pressurizer of the pivoting guider.

3. The foldable container of claim 1, wherein the elastic pivoting device comprises a hinge body which comprises a rod hinge and a guider hinge and is coupled to the upper plate or the lower plate such that one end of the pivoting rod pivots due to the rod hinge and the guider body of the pivoting guider pivots due to the guider hinge.

4. A foldable container configured to allow a pair of side plates to be foldable between an upper plate and a lower plate, wherein:

the side plate is configured to allow an upper side plate and a lower side plate to be folded inward using a hinge portion, the upper and lower side plates of the side plate comprise upper and lower molds at corners of both sides thereof, respectively, and a locking means moves such that the upper and lower molds are mutually locked or unlocked, wherein a space portion is formed in the upper plate, and a front panel and a rear panel are provided therein and slide outward from the upper plate to cover a front surface and a rear surface of the foldable container, and wherein front and rear molds are provided at corners of both sides of the front panel and the rear panel, respectively, and a locking means moves such that the side plate and the front and rear molds of the front and rear panels are mutually locked or unlocked.

5. The foldable container of claim 4, wherein coupling pieces are formed at bottom ends of the front panel and the rear panel, respectively, and are inserted into and fixed to coupling grooves of the lower plate, respectively.

6. The foldable container of claim 4, wherein one side plate of the pair of side plates is formed to partially correspond to the other side plate and comprises an open portion formed on a side surface thereof.

7. The foldable container of claim 6, wherein an independent frame is formed at the open portion to allow an upper frame and a lower frame to be folded inward using a frame hinge portion.

8. A foldable container configured to allow a pair of side plates to be foldable between an upper plate and a lower plate, wherein:

the side plate is configured to allow an upper side plate and a lower side plate to be folded inward using a hinge portion, the upper and lower side plates of the side plate comprise upper and lower molds at corners of both sides thereof, respectively, and a locking means moves such that the upper and lower molds are mutually locked or unlocked, wherein the locking means comprises guide rails at the upper and lower molds, respectively, and comprises a coupling rail with one end coupled to any one of the guide rails to pivot due to a rail hinge and another end on which a sliding member slides along the coupling rail to be pressurized outward by an elastic member such that the sliding member is inserted into and coupled to any one of the guide rails.

9. The foldable container of claim 8, wherein the sliding member comprises a rail holder and the guide rails and comprise holding grooves such that the rail holder is held by and fixed to the holding groove.

* * * * *